US006486766B1

(12) United States Patent
Reid et al.

(10) Patent No.: US 6,486,766 B1
(45) Date of Patent: Nov. 26, 2002

(54) HOUSING FOR DOUBLE-ENDED FUSE

(75) Inventors: Carl S. Reid, Northbrook, IL (US); Seibang Oh, Elk Grove Village, IL (US)

(73) Assignee: Littlefuse, Inc., DesPlaines, IL (US)

( * ) Notice: Subject to any disclaimer, the term of this patent is extended or adjusted under 35 U.S.C. 154(b) by 0 days.

(21) Appl. No.: 09/524,631

(22) Filed: Mar. 14, 2000

(51) Int. Cl.[7] ..... H01H 85/175; H01H 85/02; H01R 13/68; H01R 33/95

(52) U.S. Cl. ..... 337/186; 337/251; 337/252; 337/180; 337/187; 439/622

(58) Field of Search ..... 337/180, 186, 337/227, 228, 251, 231, 246, 248, 252, 187; 29/623; 439/835, 893, 621, 622

(56) References Cited

U.S. PATENT DOCUMENTS

| | | | | | |
|---|---|---|---|---|---|
| 3,678,432 | A | * | 7/1972 | Boliver | 337/201 |
| 4,047,143 | A | * | 9/1977 | Burden et al. | 337/239 |
| 4,060,785 | A | * | 11/1977 | Hanke et al. | 337/201 |
| 4,164,726 | A | * | 8/1979 | Weibe | 337/215 |
| 4,563,666 | A | * | 1/1986 | Borzoni | 337/252 |
| 4,604,602 | A | * | 8/1986 | Borzoni | 337/264 |
| 4,608,548 | A | * | 8/1986 | Borzoni | 337/201 |
| 4,837,546 | A | * | 6/1989 | Bernstein | 337/272 |
| 4,894,633 | A | * | 1/1990 | Holtferter | 337/278 |
| 5,229,739 | A | | 7/1993 | Oh et al. | |
| 5,293,147 | A | | 3/1994 | Oh et al. | |
| 5,854,583 | A | * | 12/1998 | Falchetti | 337/290 |
| 5,903,209 | A | * | 5/1999 | Stepniak | 337/224 |
| 6,046,665 | A | * | 4/2000 | Oh et al. | 337/191 |
| 6,067,004 | A | * | 5/2000 | Hibayashi et al. | 337/227 |

* cited by examiner

*Primary Examiner*—Anatoly Vortman
(74) *Attorney, Agent, or Firm*—Bell, Boyd & Lloyd LLC

(57) ABSTRACT

A shield for an electrical fuse, including an inner enclosure for housing the electrical fuse and a pair of outwardly flaring end portions extending from the opposite ends of the enclosure. The shield includes walls separating the inner enclosure from each of the outwardly flaring end portions, and a slot in the walls for the extension through that slot of at least a terminal portion of the electrical fuse. The shield may be made of a pair of identical housing pieces with mating tongue and groove elements disposed substantially along the peripheries of those pieces. Preferably, the tongue element of the housing pieces is disposed on the opposite side as the groove element of the housing piece. Each of the outwardly flaring ends, or alternatively the walls, may cooperatively form a seal to aid in preventing entry of moisture or dirt into the shield. A sealing portion that aids in forming the seal may comprise a resilient, compressible grommet. The outwardly flaring end portions include a pair of snap-locking elements for securing a separate, connecting section to the outwardly flaring end portions.

16 Claims, 4 Drawing Sheets

20
38
74
36
78
46
34
22
70
76
10

20
22
36
68
72
74
76
78
80
84
86
13

HOUSING FOR DOUBLE-ENDED FUSE

TECHNICAL FIELD

The invention relates to a shield for a fuse, and most preferably a double-ended fuse, i.e., a fuse with dual terminals. The shield prevents access to otherwise exposed electrical terminal leads, and the shield also provides a measure of protection to the fuse enclosed within that shield from moisture, corrosion, dirt, and debris.

BACKGROUND OF THE INVENTION

Double-ended electrical fuses are depicted in U.S. Pat. Nos. 5,229,739 and 5,293,147 (hereinafter the '739 and '147 patents, respectively). The disclosures of these references, which are assigned to the assignee of the present invention, are incorporated herein by reference. As described at column 4, lines 43 et seq. of the '147patent, such fuses are generally comprised of an all metal piece 20A and a two-piece plastic housing 20B. FIG. 3 of the '147 patent depicts the all metal piece 20A and the two-piece plastic housing 20B in their assembled form to create a completed fuse. As may be seen from a review of this FIG. 3, however, the terminals 26, 26' of this fuse extend out from the housing 20B. The completed fuse is typically bolted into the electrical circuit it is designed to protect. As may also be seen in FIG. 3, holes 28 and 28' formed in the terminals 26 and 26' are used to facilitate this connection to the protected electrical circuit. Such connections usually leave the terminals 26 and 26' somewhat exposed.

For certain applications, it is desirable that the terminals be covered to prevent their exposure. For other applications, it is also desirable that the terminals be protected from moisture, corrosion, dirt, and debris. It is also desirable to prevent human contact with the energized, metallic terminals.

SUMMARY OF THE INVENTION

The invention is a shield for an electrical fuse. The shield comprises an inner enclosure for housing the electrical fuse. The inner enclosure has a pair of opposite ends. The shield also comprises a pair of outwardly flaring end portions extending from the opposite ends of the inner enclosure.

The shield includes a wall separating the inner enclosure from each of the outwardly flaring end portions. Each of these walls may include a slot for the extension through that slot of at least a terminal portion of the electrical fuse.

In another aspect of the invention, the shield is made of a pair of identical housing pieces. These identical housing pieces may include mating tongue and groove elements disposed substantially along the peripheries of those housing pieces. Preferably, the tongue element of the housing piece is disposed on the opposite side as the groove element of the housing piece.

In yet another aspect of the invention, each of the outwardly flaring ends includes a sealing portion to aid in preventing entry of moisture or dirt into the shield. In a still further aspect of the invention, the walls may cooperatively form a sealing portion to prevent entry of moisture or dirt into the shield. The sealing portion may be made of a compressible grommet.

The outwardly flaring end portions include a pair of snap-locking elements for securing a separate, male connecting section to each of the outwardly flaring end portions.

DETAILED DESCRIPTION OF THE PREFERRED EMBODIMENT

This invention is susceptible of many different forms or embodiments. The drawings and the specification describe in detail a preferred embodiment of the invention. This disclosure is to be considered as one example of the principles of the invention. This disclosure is not intended to limit the broad aspect of the invention to the illustrated embodiment.

Figure 1:
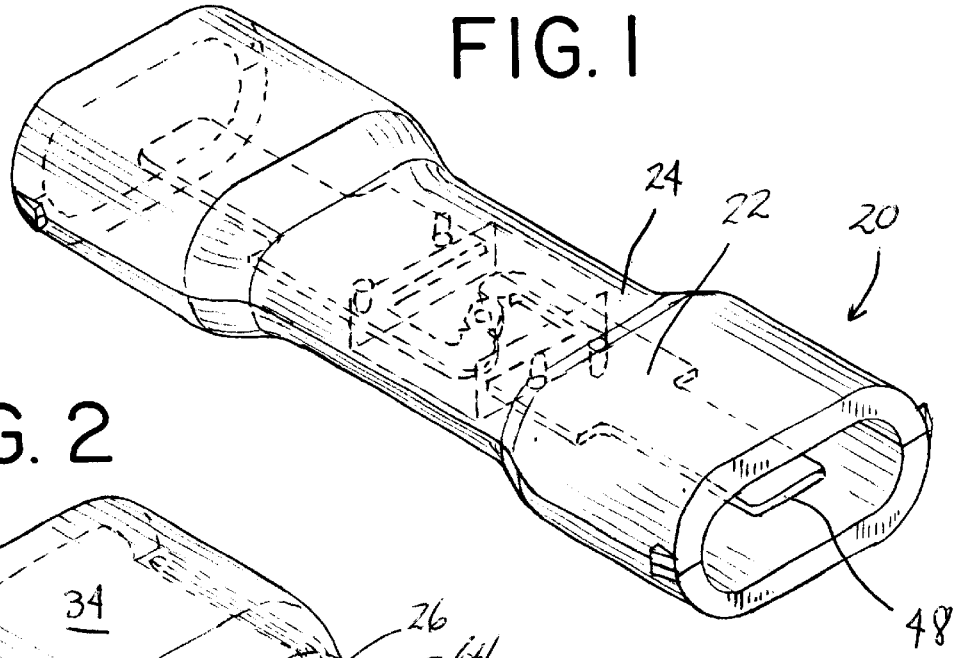
FIG. 1 is a perspective view of a shield for the present invention, and showing in dotted lines the fuse which the shield is intended to protect.
Figure 4:
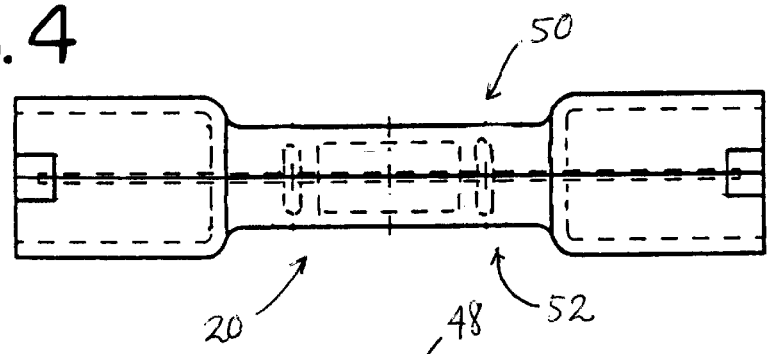
FIG. 4 is a side elevational view of the shield of FIG. 1.

The invention is shown in FIGS. 1–13. FIG. 1 is a perspective view of a shield for the present invention, and containing the fuse which the shield is intended to protect. The shield 20 is designed to securely hold an electrical fuse element 22. A suitable electrical fuse element 22 is the all-metal piece, i.e., item 20A in FIG. 4 of U.S. Pat. No. 5,293,147, and described in that patent.

Figure 6:
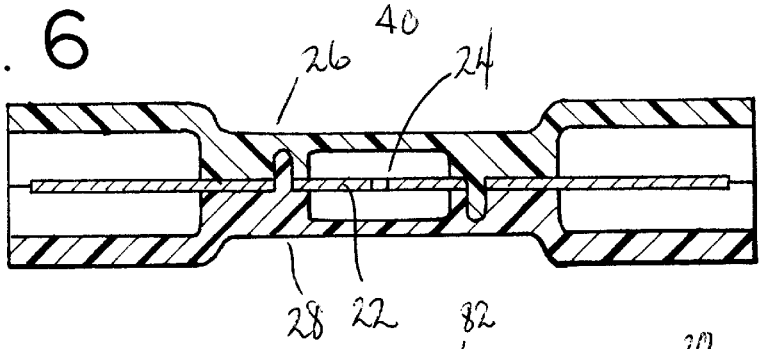
FIG. 6 is a cross-sectional view, taken through lines 6—6 of FIG. 3, showing the fuse contained within the shield of the invention.
Figure 7:
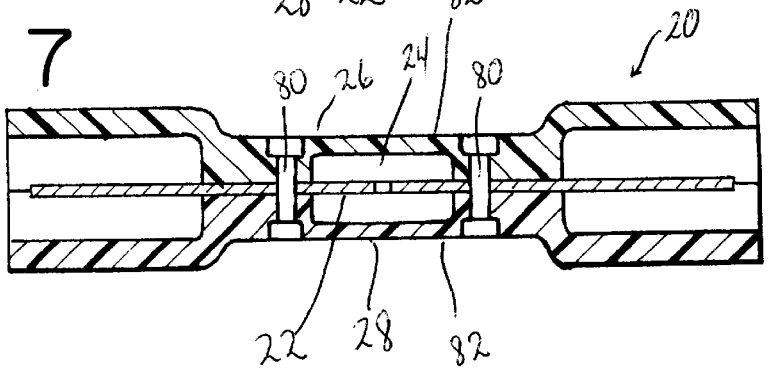
FIG. 7 is a cross-sectional view of a shield similar to that of FIG. 6, but providing rivets rather than posts to secure the fuse within the shield.

As may be seen from FIGS. 1, 6, and 7, the shield 20 comprises an inner enclosure 24 for housing a part of the electrical fuse element 22. In this embodiment, this inner enclosure 24 is a chamber that is bound by a pair of walls 26 and 28 that make up an intermediate portion of the shield 20.

Figure 2:
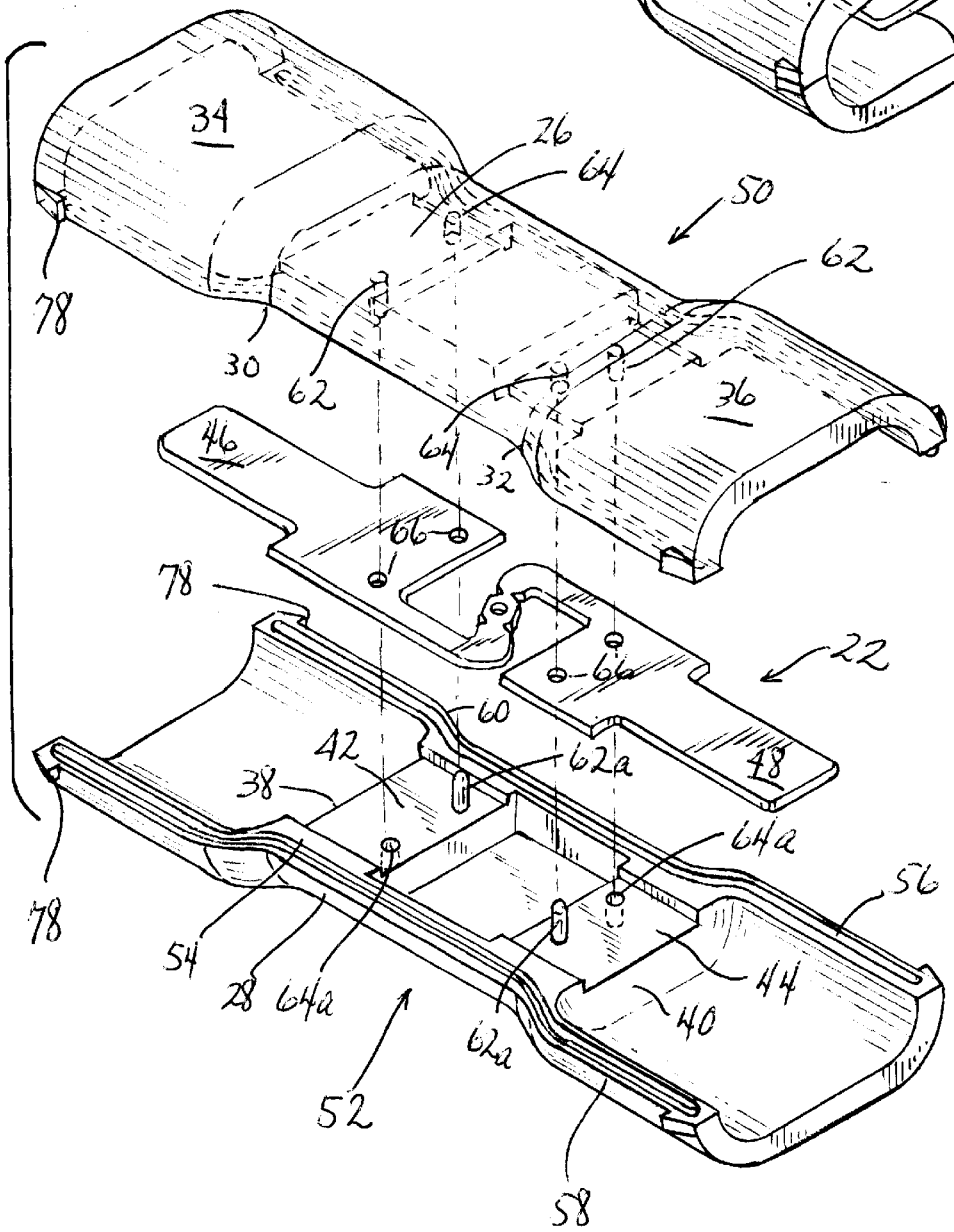
FIG. 2 is an exploded view of the shield of FIG. 1, and also showing the fuse.
Figure 3:
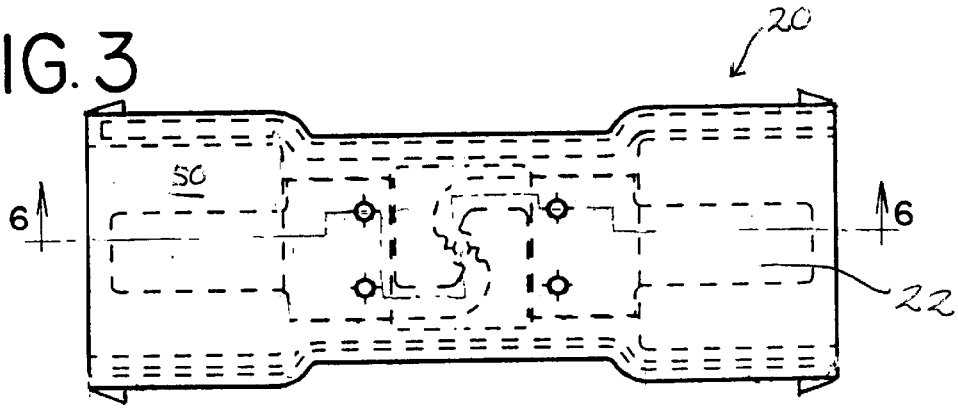
FIG. 3 is a front elevational view of the shield of FIG. 1.

The inner enclosure 24 terminates at a pair of opposite ends 30 and 32 (FIG. 2). Extending from these opposite ends 30 and 32 of the inner enclosure are a pair of outwardly flaring end portions 34 and 36. As may best be seen in FIGS. 3 and 4, the outwardly flaring end portions 34 and 36 combine with the intermediate portion to form the shield 20, having the appearance of a somewhat flattened dumbbell.

A suitable non-conducting material may be used to fabricate the shield 20. Most preferably, a hard polymer may be used. The most preferred material for this shield 20 is polyphthalamide. This material may be injection molded.

Figure 5:
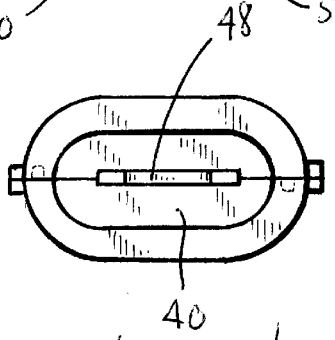
FIG. 5 is an end elevational view of the shield of FIG. 1.

As may best be seen in FIGS. 2 and 5, this shield 20 includes walls 38 and 40 that separate or isolate the inner enclosure 24 from each of the outwardly flaring end portions 34 and 36. These walls 38 and 40 are disposed at a position adjacent the opposite ends 30 and 32, respectively. Slots 42 and 44 are provided in the walls 38 and 40, respectively. The terminal portions 46 and 48 of the electrical fuse element 22 extend through these slots 42 and 44, respectively. The perimeters of the wall structures forming these slots 42 and 44 are preferably sized such that they tightly grip the terminals 46 and 48. This gripping action on terminals 46 and 48 both stabilizes the fuse element 22 and assists in keeping moisture, dirt, and debris from entering the inner enclosure 24.

As may best be seen in the exploded view of FIG. 2, in one aspect of the invention the shield 20 is made of a pair of identical housing pieces 50 and 52. As noted above, these housing pieces 50 and 52 can be made of a material that may be injection molded. Because of the identity of these housing pieces 50 and 52, only one mold need be made to produce them, resulting in some cost savings.

As may also be seen in FIG. 2, these identical housing pieces 50 and 52 may include mating tongue 54 and groove 56 elements. In this embodiment, as may be seen with respect to lower housing piece 52, these tongue 54 and groove 56 elements are disposed, respectively, substantially along the peripheries 58 and 60 of the housing piece 52.

As may also be seen in FIG. 2, the two housing pieces 50 and 52 are mated by inverting one housing piece 50 and placing it adjacent the other housing piece 52, such that the tongue of one mates with the groove of the other. Preferably, as shown in FIG. 2, the tongue element 54 of the housing piece 52 is disposed on the opposite side as the groove element 56 of that same housing piece 52.

As may best be seen in FIGS. 1, 2, 4 and 6, the electrical fuse element 22 is retained within the enclosure 24 by posts 62 and 62*a* or holes 64 and 64*a* within each of the respective housing pieces 50 and 52. Two posts 62 and 62*a* and two holes 64 and 64*a* are provided in each of the housing pieces 50 and 52. The posts 62 are diagonally across from each other, and the holes 64 are also diagonally across from each other. As may be seen in FIG. 2, when two housing pieces 50 and 52 are assembled, the posts 62 from one piece 50 engage the holes 64*a* from the other piece 52. The posts and holes together engage orifices 66 in the electrical fuse element 22 to secure that element 22 within the inner enclosure 24 of the shield 20.

An adhesive or other sealant may be placed in the junction between the tongue 54 and its corresponding, mating groove 56. When this sealant or adhesive dries, it will provide the shield 20 with an additional measure of water resistance.

Figures 8, 9, 10:
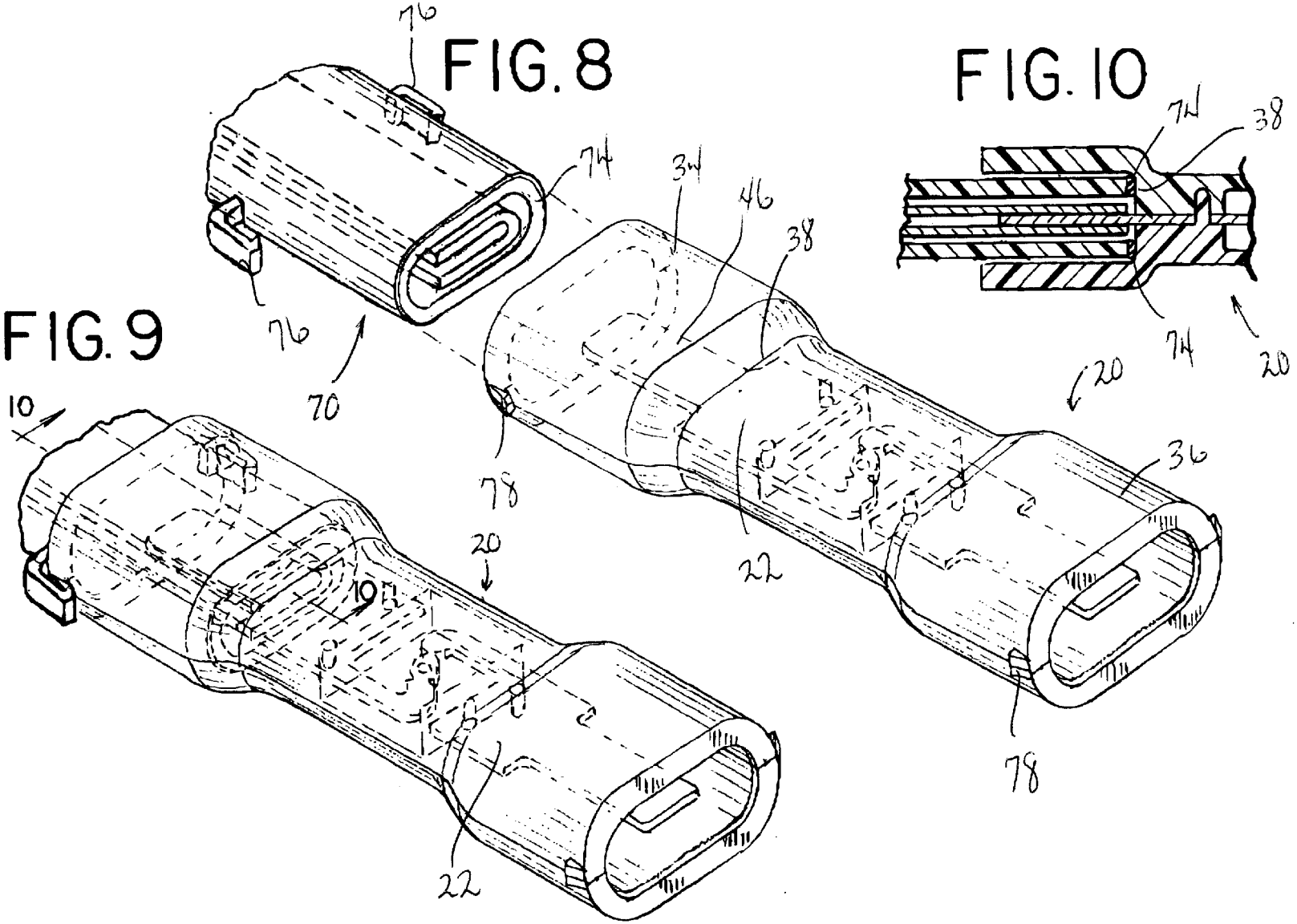
FIG. 8 is a perspective view of a typical male connector that may be secured to the shield of the invention, and the shield of the invention.
FIG. 9 is a perspective view of the male connector of FIG. 8, secured to the shield of FIG. 1.
FIG. 10 is a cross-sectional view of the connector/shield combination of FIG. 9, taken along lines 10—10 of FIG. 9.

As may best be seen in FIGS. 8 and 10, yet another aspect of the invention includes, on the outwardly flaring ends 34 and 36, a seal to aid in preventing entry of moisture or dirt into the shield 20. Referring to FIG. 8, a male connector 70 is shown in a position to engage the shield 20 and the end terminal 46 of the electrical fuse element 22. When the male connector 70 is moved into engagement with the shield 20, as shown in FIGS. 9 and 10, a seal may be created by the tight engagement of a second seal 74 on the male connector 70 with the wall 38 of the shield 20. This second seal 74 may comprise a compressible or compression-fit grommet. A preferred material for this grommet is rubber or any other suitable similar elastomeric material.

In order to keep the male connector 70 firmly secured to the shield 20, the male connecting section or connector 70 includes a pair of resilient snap-locking elements 76 that are snap-fitted into place over a corresponding pair of ramped tabs 78 molded into the outer ends of each of the outwardly flaring end portions 34 and 36.

Figures 11, 12, 13:
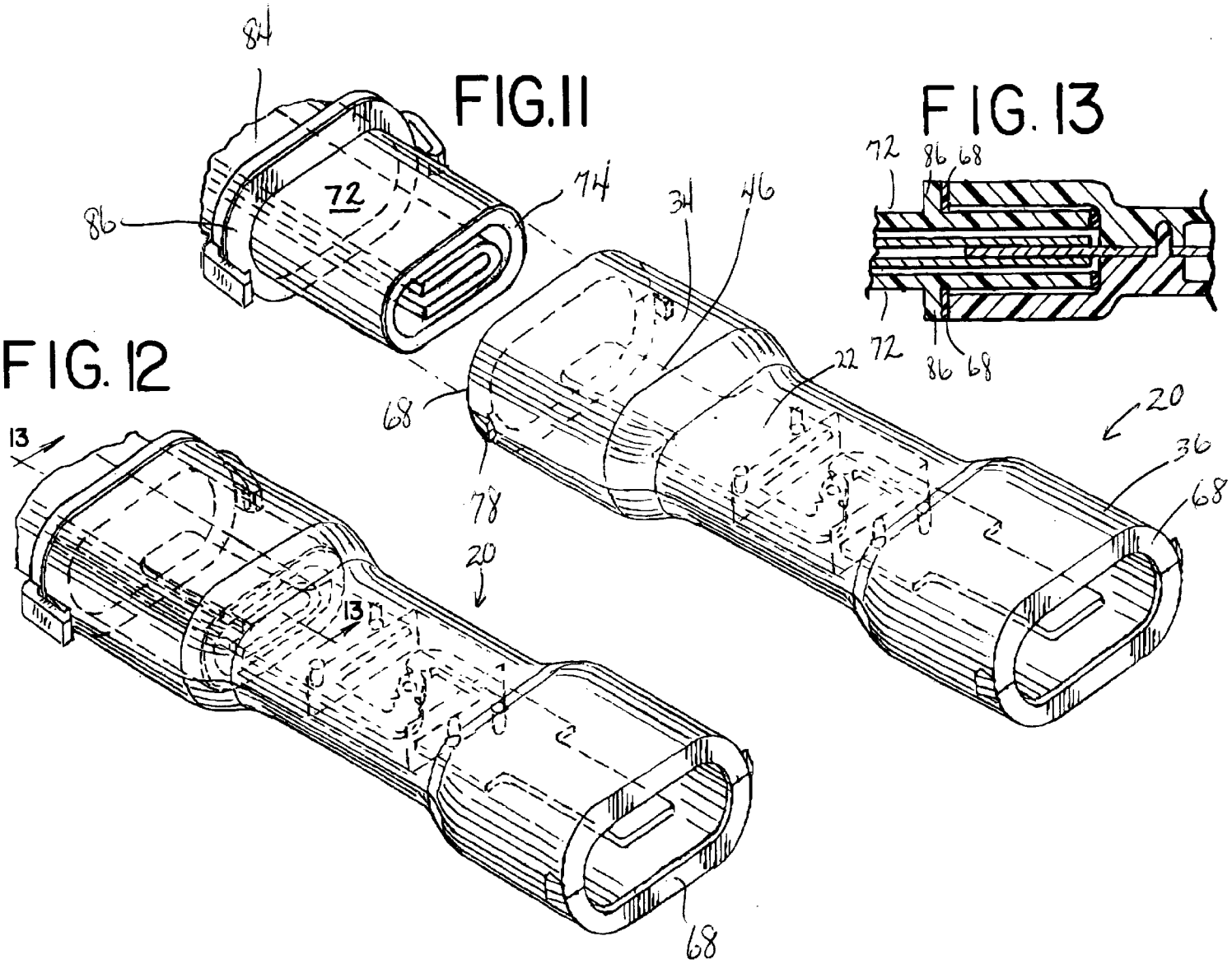
FIG. 11 is a perspective view of a slightly revised male connector that may be secured to the shield of the invention, and the shield of the invention.
FIG. 12 is a perspective view of the male connector of FIG. 11, secured to the shield of FIG. 1.
FIG. 13 is a cross-sectional view of the connector/shield combination of FIG. 12, taken along lines 13—13 of FIG. 12.

A slightly modified structure is shown in FIGS. 11–13. The seals created by this structure may either be used alone, as shown in FIGS. 11–13, or in conjunction with the seals shown in FIGS. 8–10. In the aspect of the invention shown in FIGS. 11–13, the male connector 84 has, around its external walls 72, a flange or shoulder 86. As may be seen in FIGS. 12 and 13, as the male connector 84 is moved into its locked position adjacent the outwardly flaring end portion 34 of the shield 20, the shoulder 86 abuts against and compresses the sealing portion 68. The compression of this sealing portion 68 against the shoulder 86 creates a seal, and aids in preventing entry of moisture or dirt into the shield 20.

Finally, a slightly different alternative embodiment is shown in FIG. 7. In this embodiment, rivets 80 are provided to secure the electrical fuse element 22 within the shield 20. These rivets 80 extend through the outer walls 82 of the shield 20. These rivets 80 are used in lieu of the posts 62 and holes 64 of the embodiment of FIG. 1.

While the specific embodiments have been illustrated and described, numerous modifications are possible which would not significantly depart from the spirit of the invention or the scope of the claims. Thus, the protection is to be limited only by the scope of the accompanying claims.

What we claim is:

1. A shield for an electrical fuse, said shield comprising: (a) an inner enclosure for housing said electrical fuse, said inner enclosure having a pair of opposite ends; (b) a pair of outwardly flaring end portions extending from the opposite ends of said inner enclosure, said end portions respectively housing at least part of a terminal portion defined by said electrical fuse, and wherein the inner enclosure and end portions are formed via a pair of identical housing pieces that include mating tongue and groove elements disposed substantially along the peripheries of the pieces.

2. The shield as set forth in claim 1, comprising a wall separating the inner enclosure of the shield from each of the outwardly flaring end portions.

3. The shield as set forth in claim 2, wherein walls include a slot, for the extension through that slot of at least a terminal portion of said electrical fuse.

4. The shield as set forth in claim 1, wherein the tongue element of said piece is on the opposite side of the groove element of said piece.

5. The shield as set forth in claim 2, wherein each of said outwardly flaring ends includes a sealing portion to aid in preventing entry of moisture or dirt into the shield.

6. The shield as set forth in claim 2, wherein said walls cooperatively form a sealing portion to aid in preventing entry of moisture or dirt into the shield.

7. The shield as set forth in claim 5, wherein said sealing portion includes a compressible grommet.

8. The shield as set forth in claim 6, wherein said sealing portion includes a compressible grommet.

9. The shield as set forth in claim 5, wherein said outwardly flaring end portions include a ramped tab for engaging snap-locking elements to secure a connecting section to said outwardly flaring end portions.

10. The shield as set forth in claim 6, wherein said outwardly flaring end portions include a ramped tab for engaging snap-locking elements to secure a connecting section to said outwardly flaring end portions.

11. A shield for a fuse comprising:

a first housing piece having an inner portion for covering a first portion of the fuse and a pair of flared end portions for covering second and third portions of the fuse;

a second housing piece having an inner portion for covering the first portion of the fuse and a pair of flared end portions for covering the second and third portions of the fuse; and means for attaching the first and second housing pieces.

12. The shield of claim 11, wherein the attachment means includes a tongue extending from the first housing piece and a mating groove in the second housing piece.

13. The shield of claim 11, wherein the attachment means includes an adhesive.

14. The shield of claim 11, wherein the attachment means includes a post extending from the first housing piece and a mating hole in the second housing piece.

15. The shield of claim 11, wherein the attachment means includes a rivot extending through the first and second housing pieces.

16. The shield of claim 11, wherein the attachment means also fixes the fuse within the first and second housing pieces.

* * * * *